US005252036A

United States Patent [19]

Bunch et al.

[11] Patent Number: 5,252,036

[45] Date of Patent: Oct. 12, 1993

[54] NORMAL DIRECTION HEATER FOR COMPRESSOR CRANKCASE HEAT

[75] Inventors: Rick L. Bunch, Tecumseh; Robert L. Morse, Clayton; Tara C. Kandpal, Tecumseh, all of Mich.

[73] Assignee: Tecumseh Products Company, Tecumseh, Mich.

[21] Appl. No.: 540,477

[22] Filed: Jun. 19, 1990

[51] Int. Cl.[5] ..... F04B 21/00; F25B 43/02

[52] U.S. Cl. ..... 417/313; 417/572; 62/472

[58] Field of Search ..... 417/313, 572, 902; 62/472; 184/6.22

*Primary Examiner*—Richard A. Bertsch

*Assistant Examiner*—Alfred Basichas

*Attorney, Agent, or Firm*—Baker & Daniels

[57] ABSTRACT

The present invention is a crankcase heater for preventing the migration of liquid refrigerant. The heater is located on the compressor housing surface near the oil sump. The heater is positioned within a fence of a terminal assembly, covering substantially all the surface area enclosed by the fence except for the terminal cluster itself. The heater provides heat to the housing and the interior of the compressor, and the gasket insulates the heater and interiorly reflects the heat produced. Liquid refrigerant in the oil sump is boiled off to increase the pressure inside the housing and inhibit migration of refrigerant from the evaporator or accumulator.

21 Claims, 3 Drawing Sheets

NORMAL DIRECTION HEATER FOR COMPRESSOR CRANKCASE HEAT

BACKGROUND OF THE INVENTION

This invention relates to hermetic compressors. More particularly, the field of the invention is that of crankcase heaters for low pressure hermetic compressors which prevent the migration of refrigerant from the evaporator side of a refrigeration system to the compressor.

During routine operation of a refrigeration system, the compressor is intermittently shut down by a thermostat. When the compressor is thermostatically shut down, and also when the refrigeration system is de-energized, the compressor ambient temperature decreases. Gaseous refrigerant from the evaporator or accumulator can migrate through the suction line and into the compressor where the lower temperature condenses the refrigerant. The presence of liquid refrigerant in the compressor on startup can cause liquid slugging, which may rupture the compressor gaskets, damage bearings, and the like due to the resulting high pressures.

One type of prior art compressor includes a solid state heater or the like and is in thermal contact with the compressor housing or the oil and refrigerant in the sump. The heater helps to prevent the problem of liquid refrigerant migrating from the evaporator, traveling through the suction line, and entering the compressor. Further, compressor crankcase heaters have been installed to decrease the temperature difference between the evaporator side and the compressor ambient temperatures, and given a sufficient period of time the crankcase heater reduces liquid migration.

One benefit of a crankcase heater is the ability to boil off liquid refrigerant in the oil sump. One such crankcase heater is disclosed in U.S. Pat. No. 4,755,657, which includes a PTC heater mounted in a shallow depression at the bottom of the compressor housing. However, this design has several disadvantages. One disadvantage involves the shallow depression which is a required modification to the compressor housing. Such a modification may not be desirable for the housing, and the heater cannot be used with already existing compressors not having such a depression. Another disadvantage is that the system must have some means for attaching the PTC heater to the compressor.

A need still exists for a crankcase heater which is efficient to produce, convenient to install, effective in operation, and which does not require alteration of the compressor housing.

SUMMARY OF THE INVENTION

The present invention is a crankcase heater for use with a compressor within a refrigeration system. The device radiates heat to the oil sump and heats the housing of the compressor around the sump to heat the liquid in the sump and boil off liquid refrigerant. Boiling off liquid refrigerant increases the pressure and inhibits refrigerant in the evaporator side from migrating and accumulating in the compressor. The heater lies directly upon the housing to thermally contact the outer surface of the housing.

The heater of the present invention is located near the terminal cluster of the hermetic compressor. Thus, a separate structure on the housing to support the heater is not required because the heater is disposed within the protective fence of the terminal. By positioning the heater within the fence and under the protective cap, the device is protected against damage. Further, the gasket, cover, and fence around the terminal cluster enclose the heater and thermally isolate it from the exterior, and the heater radiates heat inwardly to maintain the proper temperature in the sump.

Substantially all the available surface area inside the fenced area is contacted to provide the maximum effective surface area for the heater. By simply laying the heater on the compressor housing within the fenced area, the assembly, connection, and operation of the heater of the present invention is greatly facilitated. A thermally insulating gasket holds the heating element against compressor housing and reflects the heat interiorly to maximize the heat delivered to the sump. Also, the heater of the present invention provides a steeper slope of watts versus temperature, indicating the greater efficiency of the present invention.

The heater is located on the outer surface of the compressor housing, near the oil sump. A significant percentage of the liquid in the oil sump is not oil, rather liquid refrigerant which has migrated in gaseous form and condensed in the compressor housing. The heater boils off much of the liquid refrigerant, causing a positive gas pressure inside the compressor housing which deters refrigerant migration. This is especially important for hermetic compressors with low pressure domes, because during shut-down gas refrigerant from the evaporator or accumulator tends to migrate to and condense in the compressor if there is no pressure inside the housing.

The position of the heater on the outer surface of the compressor provides beneficial self-regulating properties. Located near the top of the liquid level in the oil sump, the heater transmits more heat to liquid which is adjacently located. Liquid refrigerant causes the sump level to rise, bringing more liquid in the sump into contact with the housing adjacent the heater. Thus, the effectiveness of the heater rises as the amount of liquid refrigerant rises.

The present invention is, in one form thereof, a compressor including an outer housing, a motor-pump unit, a terminal assembly, and a heater. The outer housing defines an interior region having an oil sump therein. The motor-pump unit is disposed within the interior region of the housing, and the terminal assembly is located on the housing and includes a terminal cluster. The heater is disposed over a portion of the housing adjacent to the terminal cluster, to be in thermal proximity to liquid in the oil sump.

Preferably, the surface area of the heater is relatively large in relation to the thickness of the heater, and the portion of the housing surface covered by the heater is located at or directly adjacent to the oil sump. The assembly is arranged so that liquid in the oil sump receives heat radiated from the heater. A gasket may be positioned over the heater to insulate the heater from the ambient and reflect heat to liquid in the oil sump.

One object of the present invention is to provide a more cost effective crankcase heater for a hermetic compressor which heats the oil sump of the compressor.

Also, an object of the present invention is to heat liquid refrigerant in the oil sump to maintain a positive pressure within the housing which deters refrigerant migration from the suction line.

An additional object is to provide a crankcase heater which transfers a greater amount of heat to liquid in the oil sump when liquid refrigerant accumulates therein.

Another object of the present invention is to provide an external crankcase heater which is protected from external disturbances.

Yet another object of the present invention is to provide a heater on the compressor housing which does not require modification to the housing or terminal structure.

A further object of the present invention is to provide a crankcase heater with good thermal transfer.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Figure 1:
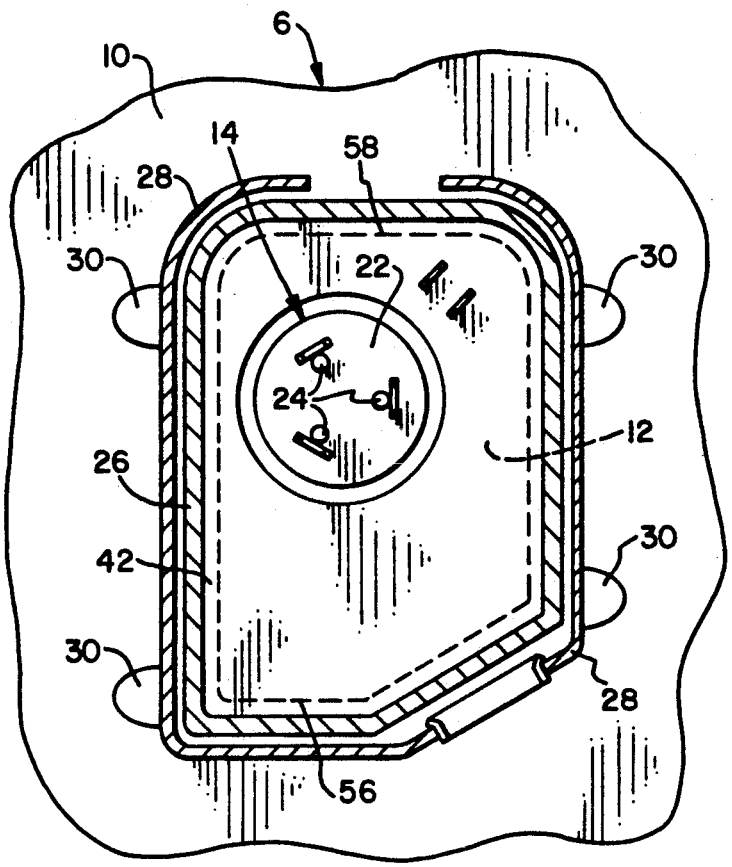
FIG. 1 is a plan view in partial cut-away of a compressor terminal cluster including the heater of the present invention.
Figure 3:
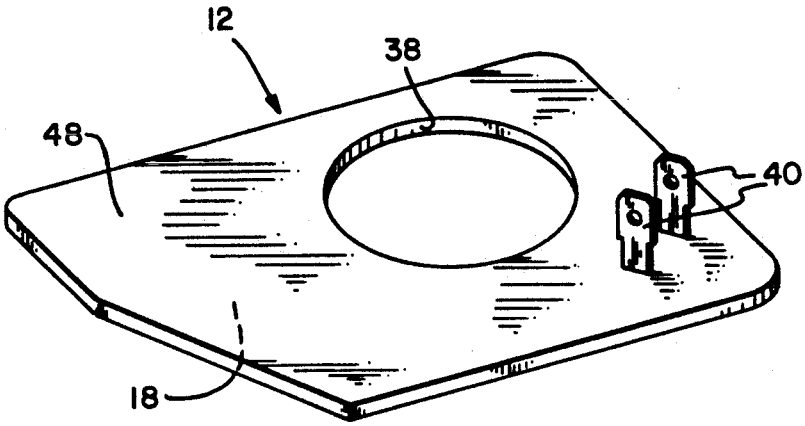
FIG. 3 is a perspective view of the heating element of the present invention.

Corresponding reference characters indicate corresponding parts throughout the several views. The exemplifications set out herein illustrate a preferred embodiment of the invention, in one form thereof, and such exemplifications are not to be construed as limiting the scope of the disclosure or the scope of the invention in any manner.

DESCRIPTION OF THE PREFERRED EMBODIMENT

Figure 4:
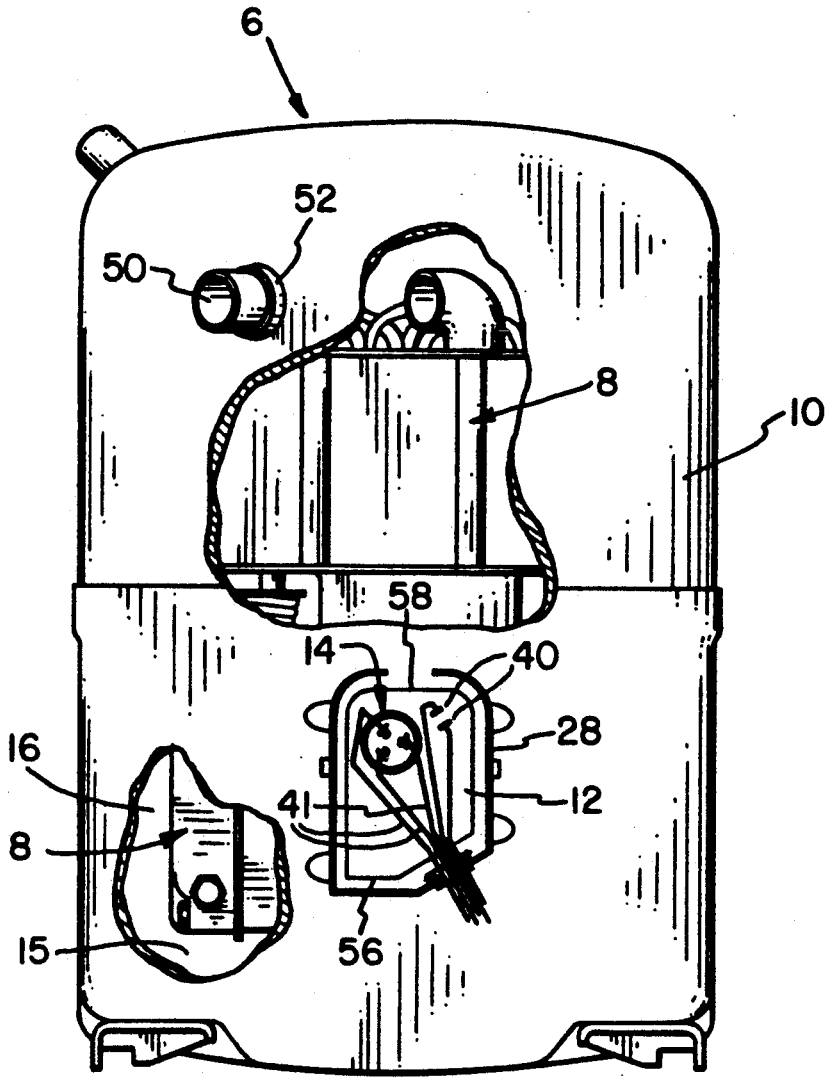
FIG. 4 is a front elevation view of the compressor in partial cut-away with the cover, bale strap, and gasket removed.

Referring to FIG. 4, compressor 6 comprises a motor-pump unit 8 sealed within housing 10. The present invention concerns a crankcase heater 12 which is located on housing 10 directly adjacent terminal cluster 14.

In accordance with the present invention, heater 12 provides heat to oil in oil sump 15 by virtue of its position on the surface of housing 10. The surface over which heater 12 is located is either generally planar or slightly curved. Heater 12, which may be a positive temperature coefficient (PTC) element or other heater, radiates heat through housing 10 and into interior region 16 to heat oil and any refrigerant liquid in oil sump 15. Bottom surface 18 (FIG. 2) of heater 12 faces and is in direct thermal contact with outer surface 20 of housing 10. Thus, heater 12 maximizes heat transfer to housing 10 for boiling off any liquid refrigerant in oil sump 15.

Terminal cluster 14 is of known design and is similar to that described in U.S. Pat. No. 4,406,590, which is expressly incorporated by reference herein. Preferably, terminal cluster 14 (FIG. 1) comprises a cylindrical cup 22 welded to housing 10, with cup 22 containing a plurality of pins 24 extending out of housing 10. Terminal cluster 14 and heater 12 are protected from the elements and shielded by cover 26, and a similarly contoured protective fence 28 surrounds cover 26. Mounting flange 30 of fence 28 has a lower surface 32 (FIG. 2) that is welded to housing 10. Cover 26 is held in place by bail strap 34 that hooks over ears 36 of fence 28.

Figure 2:
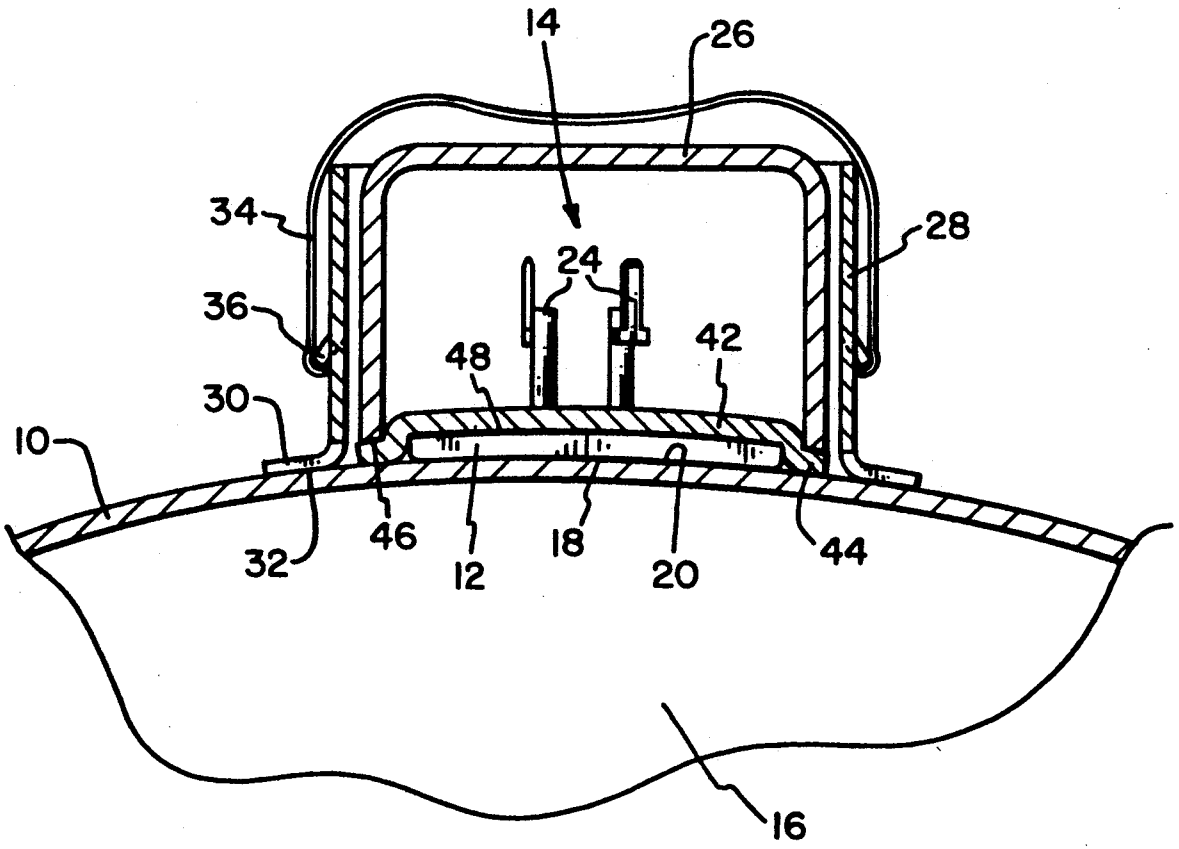
FIG. 2 is a sectional view of the terminal cluster and heater.

Heater 12 covers substantially all of the available surface area bounded by the perimeter of fence 28. Referring to FIG. 2, heater 12 has a shape similar to the shape of fence 28, although slightly smaller. Opening 38 of heater 12 encircles cluster 14, which is located near wire leads 40. In one embodiment, the thickness of heater 12 is 0.135 inches, in contrast with its length of 2.930 inches and width of 2.004 inches. Thus, heater 12 is contoured to fit around terminal cluster 14 and fit within fence 18 while maximizing its surface area in contact with outer surface 20 in comparison to its total size.

Spade terminals 40 are adapted to connect heater 12 to the power side of the contactor and provide electric current (FIG. 4). Heater 12 is available from Raychem Chemelex Division, 300 Constitution Drive, Menlo Park, California. Heater 12 produces about 24 to 34 watts at ambient temperatures of 100° to −20° C.

Gasket 42 is disposed over heater 12 and has a peripheral portion 44 compressed under lower edge 46 of cover 26. Gasket 42 is positioned over upper surface 48 of heater 12 and cover 26 holds gasket 42 against housing 10 and heater 12 to firmly maintain good thermal contact. Gasket 42 is preferably made of a rubber or rubber-like material to insulate heater 12 and to reflect heat back towards interior region 16. Additionally, gasket 42 seals cover 26 to housing 10 in a conventional manner. Preferably, the material of gasket 42 is closed cell neoprene rubatex.

Referring to FIG. 4, suction line 50 enters housing 10 through suction inlet 52, and is in communication with motor-pump unit 8. The heat produced by heater 12 boils off liquid refrigerant in oil sump 15 to keep the gas pressure inside housing 10 at a level which deters migration of refrigerant from the evaporator side of the refrigeration system (not shown). To effectively prevent migration, only a percentage of the liquid refrigerant need be boiled off, for example 70%.

Heater 12 can be positioned relatively low on housing 10, with bottom edge 56 of heater 12 either slightly below, even, or above the liquid level that normally exists in oil sump 15 during compressor operation. Heater 12 more efficiently transfers heat to liquid in sump 15 when located adjacent to the liquid. Thus, liquid refrigerant is boiled off more efficiently as the liquid level rises to heights closer to top edge 58 of heater 12.

In operation, the liquid level in sump 15 is close to bottom 56 when motor-pump unit 8 runs. After shutdown, some refrigerant migrates to and then condenses inside housing 10. The additional liquid refrigerant causes the liquid level to rise, bringing more of the liquid in sump 15 directly adjacent to the portion of housing 10 which contacts heater 12. The raised liquid level causes more heat to be absorbed by liquid in sump 15 than the original liquid level. Therefore, the additional liquid refrigerant is boiled off quickly, which raises the internal pressure and deters further refrigerant migration.

The crankcase heater 12 of the present invention can easily and efficiently be coupled to compressor 6 because it is located on outer surface 20 of housing 10. First, terminal cluster 14 and fence 28 are welded to housing 10. Next, heater 12 is placed within the perimeter of fence 28, with terminal cluster 14 extending through opening 38. Wires 41 are attached to spade terminals 40 and are then connected to the power side of the contactor. Cover 26 is compressed over gasket 42 to form a seal, and bail strap 34 is pushed over ears 36. By the present invention, costly manufacturing procedures such as projection welding of a heater or forming a heater well are not required.

For most effective results, a vessel close to the compressor should be available for storing the evaporating refrigerant. Such arrangements include an evaporator located at the same level, or an accumulator which is conventionally located adjacent to the compressor. Without some means for storing the evaporated refrigerant, vaporized refrigerant would rise out of the compressor through a vertical suction line. Eventually, the refrigerant would recondense and drain back into the compressor. Preventing evaporated refrigerant from recondensing can be accomplished by providing an evaporator on the same level, or an accumulator.

While this invention has been described as having a preferred design, it can be further modified within the teachings of this disclosure. This application is therefore intended to cover any variations, uses, or adaptations of the invention following its general principles. This application is also intended to cover departures from the present disclosure as come within known or customary practice in the art to which this invention pertains and fall within the limits of the appended claims.

What is claimed is:

1. A compressor comprising:
an outer housing including an outer surface, said housing defining an interior region having an oil sump;
a motor-pump unit disposed within said interior region of said housing;
a terminal assembly on said housing, said terminal assembly including a terminal cluster;
a heater disposed over a portion of said outer surface of said housing directly adjacent said terminal cluster, said heater located in thermal proximity to liquid in said oil sump; and
a cover on said outer surface of said housing, said cover at least partially enclosing said terminal cluster and said heater.

2. The compressor of claim 1 wherein a portion of said heater is located over a portion of said outer surface directly adjacent said oil sump.

3. The compressor of claim 1 further comprising a fence on said outer surface of said housing, said fence defining a fenced surface area of said outer surface, said cover and said heater disposed over said outer surface within said fenced surface area and covering substantially all of said fenced surface area.

4. The compressor of claim 1 wherein said heater comprises a heater body having an opening, said terminal cluster extending through said opening.

5. The compressor of claim 1 wherein said heater further comprises a heater body and electrical connectors extending from said heater body.

6. The compressor of claim 1 wherein said housing includes a suction line upwardly situated, said heater being in direct thermal contact with said outer surface of said housing in a lower portion of said housing, said heater adapted to heat conductively said housing adjacent said oil sump whereby liquid refrigerant in said oil sump is boiled off and the internal pressure inside said housing deters inward refrigerant migration from said suction line.

7. The compressor of claim 1 wherein said heater comprises a positive temperature coefficient element.

8. The compressor of claim 1 wherein said terminal assembly further comprises a gasket positioned over said heater, said gasket adapted to insulate said heater from the ambient and reflect heat from said heater to said oil sump.

9. The compressor of claim 1 wherein said heater has a surface area in direct contact with said outer surface, said heater surface area being relatively large in relation to the thickness of said heater.

10. A compressor comprising:
an outer housing including an outer surface, said housing defining an interior region having an oil sump;
a motor-pump unit disposed within said interior region of said housing;
a terminal assembly on said housing, said terminal assembly including a terminal cluster and a cover disposed over said terminal cluster;
a heater disposed over a portion of said outer surface of said housing directly adjacent said terminal cluster and under said cover, said portion of said outer surface being located adjacent said oil sump whereby liquid in said sump receives heat radiated from said heater; and
a cover on said outer surface of said housing, said cover at least partially enclosing said terminal cluster and said heater.

11. The compressor of claim 10 further comprising a fence extending exteriorly on said outer surface of said housing, said fence defining a fenced surface area of said outer surface, said cover and said heater disposed over said outer surface within said fenced surface area and covering substantially all of said fenced surface area.

12. The compressor of claim 10 wherein said heater comprises a heater body having an opening, said terminal cluster extending through said opening, and said heater further comprising electrical connectors extending from said heater body.

13. The compressor of claim 10 wherein said housing includes a suction line upwardly situated, said heater being in direct thermal contact with said outer surface of said housing in a lower portion of said housing, said heater adapted to heat conductively said housing adjacent said oil sump, whereby liquid refrigerant in said oil sump is boiled out and the internal pressure inside said housing deters refrigerant migration from said suction line.

14. The compressor of claim 10 wherein said heater comprises a positive temperature coefficient element.

15. The compressor of claim 10 wherein said terminal assembly further comprises a gasket positioned over said heater, said gasket adapted to insulate said heater from the ambient and reflect heat from said heater to liquid in said oil sump.

16. The compressor of claim 10 wherein said heater has a surface area in direct contact with said outer surface, said heater surface area being relatively large in relation to the thickness of said heater.

17. A compressor comprising:
an outer housing including an outer surface, said housing defining an interior region having an oil sump;
a motor-pump unit disposed within said interior region of said housing;
a terminal assembly on said housing, said terminal assembly including a terminal cluster;

a heater disposed over a portion of said outer surface of said housing directly adjacent said terminal cluster, said heater having a surface area in direct contact with said outer surface, said heater surface area being relatively large in relation to the thickness of said heater, said portion of said outer surface being located adjacent said oil sump whereby liquid in said oil sump receives heat radiated from said heater;

a gasket positioned over said heater, said gasket adapted to insulate said heater from the ambient and reflect heat from said heater to liquid in said oil sump; and a cover on said outer surface of said housing, said cover at least partially enclosing said terminal cluster and said heater.

18. The compressor of claim 17 further comprising a fence extending exteriorly on said outer surface of said housing, said fence defining a fenced surface area of said outer surface, said cover and said heater disposed over said outer surface within said fenced surface area and covering substantially all of said fenced surface area.

19. The compressor of claim 17 wherein said heater comprises a heater body having an opening and electrical connectors extending from said heater body, said terminal cluster extending through said opening.

20. The compressor of claim 17 wherein said housing includes a suction line upwardly situated, said heater being in direct thermal contact with said outer surface of said housing in a lower portion of said housing, said heater adapted to heat conductively said housing adjacent said oil sump, whereby liquid refrigerant in said oil sump is boiled off and the internal pressure inside said housing deters inward refrigerant migration from said suction line.

21. The compressor of claim 17 wherein said heater comprises a positive temperature coefficient element.

* * * * *